US011120731B2

(12) United States Patent
Xiao

(10) Patent No.: US 11,120,731 B2
(45) Date of Patent: Sep. 14, 2021

(54) DRIVING CIRCUIT FOR DISPLAY PANEL AND METHOD OF DRIVING SAME

(71) Applicant: TCL CHINA STAR OPTOELECTRONICS TECHNOLOGY CO., LTD., Shenzhen (CN)

(72) Inventor: Bo Xiao, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/646,038

(22) PCT Filed: Jan. 9, 2020

(86) PCT No.: PCT/CN2020/071178

§ 371 (c)(1),
(2) Date: Mar. 10, 2020

(65) Prior Publication Data

US 2021/0201750 A1 Jul. 1, 2021

(30) Foreign Application Priority Data

Dec. 25, 2019 (CN) ..... 201911354666.6

(51) Int. Cl.
*G09G 3/20* (2006.01)
*G09G 3/28* (2013.01)

(52) U.S. Cl.
CPC ... *G09G 3/2092* (2013.01); *G09G 2310/0275* (2013.01); *G09G 2310/08* (2013.01); *G09G 2320/0673* (2013.01)

(58) Field of Classification Search
CPC ... G09G 2320/0271; G09G 2320/0276; G09G 2320/0673; G09G 2340/0428;
(Continued)

(56) References Cited

U.S. PATENT DOCUMENTS

2005/0168416 A1* 8/2005 Hashimoto ..... G09G 3/3291 345/76
2012/0242628 A1 9/2012 Yuan et al.
(Continued)

FOREIGN PATENT DOCUMENTS

CN 102622978 A 8/2012
CN 104916263 A 9/2015
(Continued)

OTHER PUBLICATIONS

Office Action issued in corresponding CN Application No. 201911354666.6 dated Feb. 4, 2021 (9 pages).

*Primary Examiner* — Sanghyuk Park
(74) *Attorney, Agent, or Firm* — Osha Bergman Watanabe & Burton LLP

(57) ABSTRACT

A driving circuit for a display panel and a method of driving the same are provided. The driving circuit includes that, when the time control chip is at an initialized state, the enabling control module controls the logic control module to turn off; and when the time control chip is at a state after the initialized state is finished the enable control module controls the logic control module to turn on to receive the modulating data provided by the time control chip.

17 Claims, 3 Drawing Sheets

(58) Field of Classification Search
CPC .. G09G 3/2077; G09G 3/2803; G09G 3/3607; G09G 2310/027; G09G 2310/0275; G09G 2310/08; G09G 5/18; H04N 3/127
USPC ..... 345/99
See application file for complete search history.

(56) References Cited

U.S. PATENT DOCUMENTS

| | | | | |
|---|---|---|---|---|
| 2013/0208029 | A1 | 8/2013 | Wu et al. | |
| 2016/0372072 | A1 | 12/2016 | Wu et al. | |
| 2017/0148407 | A1* | 5/2017 | Lee | G09G 3/2096 |
| 2018/0268780 | A1* | 9/2018 | Bae | G09G 5/008 |
| 2019/0164470 | A1* | 5/2019 | Cho | G09G 3/3696 |
| 2019/0251886 | A1 | 8/2019 | Wu | |
| 2021/0049973 | A1 | 2/2021 | Huang | |
| 2021/0118400 | A1 | 4/2021 | He | |

FOREIGN PATENT DOCUMENTS

| | | | |
|---|---|---|---|
| CN | 107402460 | A | 11/2017 |
| CN | 109377950 | A | 2/2019 |
| CN | 109377957 | A | 2/2019 |
| CN | 109410865 | A | 3/2019 |
| CN | 109903713 | A | 6/2019 |
| CN | 110223647 | A | 9/2019 |

* cited by examiner

DRIVING CIRCUIT FOR DISPLAY PANEL AND METHOD OF DRIVING SAME

FIELD

The present disclosure relates to display technologies, and more particularly, to a driving circuit for a display panel and a method of driving the same.

BACKGROUND

In order to improve display effect, it is often necessary to perform auto tuning (auto gamma) on a gamma curve and on a common voltage (VCOM) of display panels before leaving factories, so that each of the display panel has a gamma curve close to a standard gamma curve and has a best flicker parameter, and a modulating data is stored in a memory of a source driving chip of the display panel, and then assembled with a driving circuit.

As shown in FIG. 1, due to cost factors, input and output ports (I/O) of a time control chip 10 in the driving circuit often multiplex more functions. When power on, the time control chip 10 obtains the modulating data in the memory of the source driving chip and writes into a gamma chip 20. The time control chip 10 and the gamma chip 20 communicate with each other through a logic control module 21.

However, after power-on, the time control chip 10 resets itself for pin configuration. At this moment, the time control chip 10 outputs an uncertain signal to the gamma chip 20 and stores it in a memory module 22, thereby interfering with the gamma chip to make it work abnormally, so that the display panel cannot obtain the optimal gamma and common voltage (VCOM) parameters, which reduces the display effect.

Therefore, it is necessary to provide a driving circuit and a driving method for a display panel to solve the problems existing in the prior art.

SUMMARY

In view of the above, the present disclosure provides a driving circuit for a display panel and a method of driving the same to improve display effect.

In order to achieve above-mentioned object of the present disclosure, one embodiment of the disclosure provides a driving circuit for a display panel, including:

a source driving chip connected to the display panel and configured to store a modulating data and to provide a data signal to the display panel;

a time control chip configured to obtain the modulating data; and a gamma chip including an enabling control module and a logic control module, wherein the enabling control module is connected to the time control chip and configured to control the logic control module turning on or off according to an enabling signal output by the time control chip;

wherein the enabling control module controls the logic control module to turn off when the time control chip is at an initialized state; and wherein the enabling control module controls the logic control module to turn on to receive the modulating data provided by the time control chip when the time control chip is at a state after the initialized state is finished.

Furthermore, another embodiment of the disclosure provides a method of driving a display panel, applying on a driving circuit for the display panel, wherein the driving circuit includes:

a source driving chip connected to the display panel and configured to store a modulating data and to provide a data signal to the display panel;

a time control chip configured to obtain the modulating data; and a gamma chip including an enabling control module, a logic control module, and a storage module;

wherein the enabling control module is connected to the time control chip, and the enabling control module is configured to control the logic control module to turn on or off according to the time control chip; and wherein the method includes steps of:

the enabling control module controlling the logic control module to turn off when the time control chip is at an initialized state;

the enabling control module controlling the logic control module to turn on to receive the modulating data provided by the time control chip when the time control chip is at a state after the initialized state is finished;

wherein the enabling control module is received a power voltage, the enabling control module includes an output end, and the logic control module includes a second control end;

the enabling control module controlling the output end and the second control end disconnected when the time control chip is at the initialized state; and the enabling control module controlling the output end and the second control end connected to each other when the time control chip is at the state after the initialized state is finished.

Furthermore, another embodiment of the disclosure provides a method of driving a display panel, applying on a driving circuit for the display panel, wherein the driving circuit includes:

a source driving chip connected to the display panel and configured to store a modulating data and to provide a data signal to the display panel;

a time control chip configured to obtain the modulating date; and a gamma chip including an enabling control module and a logic control module;

wherein the enabling control module is connected to the time control chip, and the enabling control module control the logic control module to turn on or off according to an enabling signal output by the time control chip; and wherein the method includes steps of:

the enabling control module controlling the logic control module to turn off when the time control module is at an initialized state;

the enabling control module controlling the logic control module to turn on to receive the modulating data provided by the time control chip when the time control chip is at a state after the initialized state is finished.

In comparison with prior art, the driving circuit for the display panel and the method of driving the same of the disclosure provides the enabling control module to turn off the logic control module when the time control module is at the initialized state, and to turn on the logic control module to receive the modulating data provided by the time control chip when the time control chip is at the state after the initialized state is finished. The time control chip will not transmit an uncertain signal to the gamma chip at the initialized state, and will transmit the modulating data to the gamma chip after the initialized state is finished to avoid the gamma chip from disturbing and to improve display effect.

DETAILED DESCRIPTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

The terms "first", "second", and the like in the description and claims of the present application and the above-mentioned drawings are used to distinguish different objects, and are not used to describe a specific order. Furthermore, the terms "including" and "having" and any variations thereof are intended to cover non-exclusive inclusion.

Figure 1:
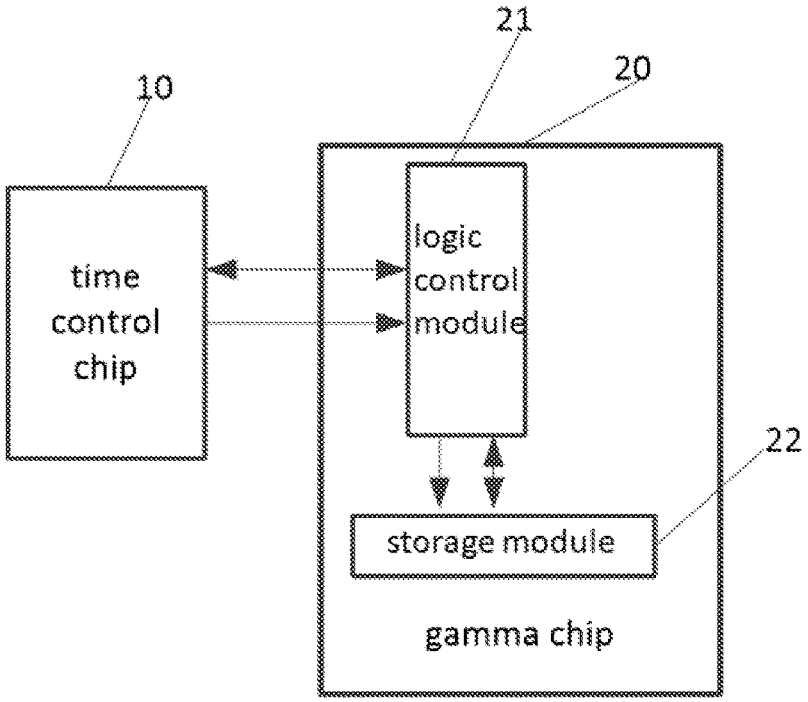
FIG. 1 is a schematic view of a structure of a driving circuit of a display panel according to prior art.
Figure 2:
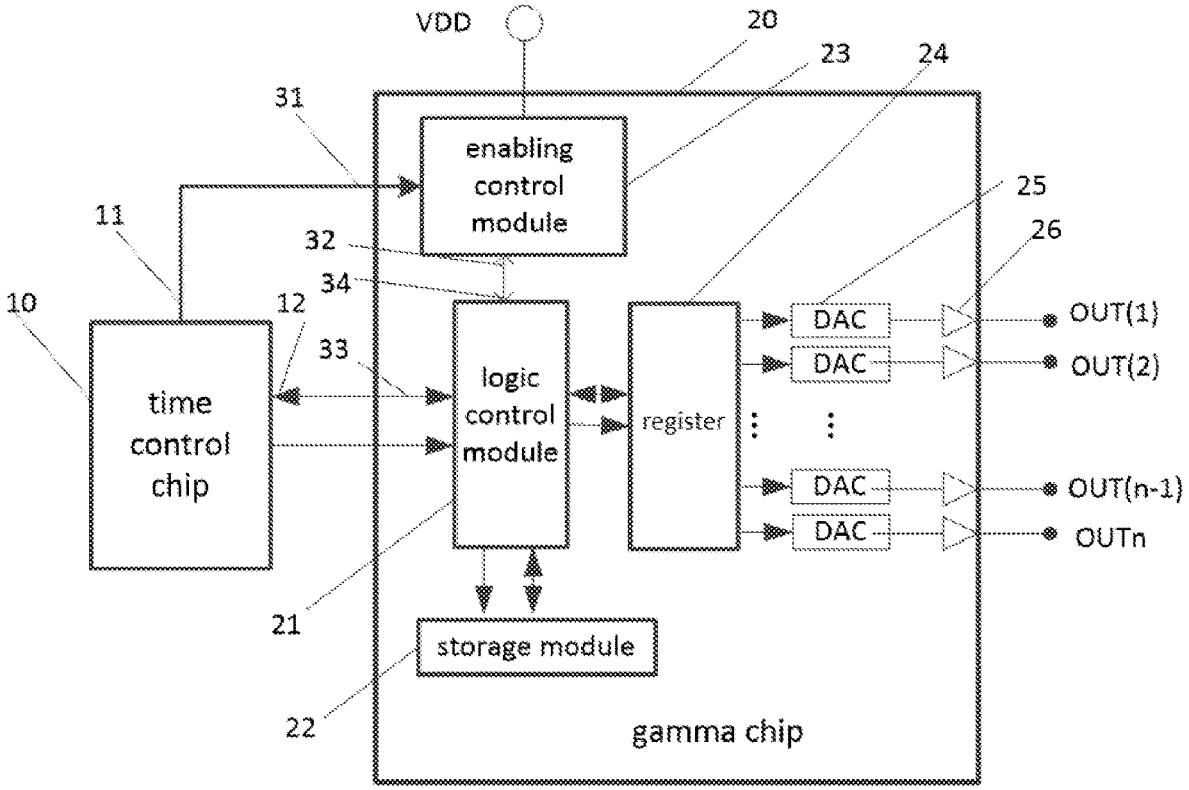
FIG. 2 is a schematic view of a structure of a driving circuit of a display panel according to an embodiment of the present disclosure.

Referring to FIG. 2, FIG. 2 is a schematic view of a structure of a driving circuit of a display panel according to an embodiment of the present disclosure.

As shown in FIG. 2, one embodiment of the disclosure provides a driving circuit for driving a display panel, including a source driving chip, a time control chip 10, and a gamma chip 20.

the source driving chip is connected to the display panel and configured to store a modulating data and to provide a data signal to the display panel. The source driving chip electrically connects with a data line of the display panel.

The time control chip 10 is configured to obtain the modulating data. The modulating data includes a gamma curve, and a common voltage (VCOM) parameter.

The gamma chip 20 includes an enabling control module 23 and a logic control module 21. The logic control module 21 is for example an $I^2C$ logic control module.

The enabling control module 23 is configured to control the logic control module 21 turning on or off. In one embodiment, the enabling control module 23 is configured to control the logic control module 21 turning on or off according to an enabling signal output by the time control chip 10.

The enabling control module 23 controls the logic control module 21 to turn off when the time control chip 10 is at an initialized state. When the time control chip 10 is at the initialized state, it configures a multiplex end 12, and an input and output (I/O) end.

The enabling control module 23 controls the logic control module 21 to turn on to receive the modulating data provided by the time control chip 10 when the time control chip 10 is at a state after the initialized state is finished. After the initialized state is finished, the multiplex end is configured as an $I^2C$ end.

In one embodiment of the driving circuit, the time control chip 10 includes a first control end 11 and a multiplex end 12. The multiplex end 12 is also the I/O end.

The logic control module 21 includes a second control end 34 and an input end 33, and the input end 33 of the logic control module is connected to the multiplex end 12.

The enabling control module 23 is received a power voltage VDD, the enabling control module 21 includes an input end 31 and an output end 32, and the input end 31 is connected to the first control end 11.

The output end 32 and the second control end 34 are disconnected when the time control chip 10 is at the initialized state.

The output end 32 and the second control end 34 are connected to each other when the time control chip 10 is at the state after the initialized state is finished.

In order to improve accuracy, the first control end 11 is at a high level when the time control chip 10 is at the initialized state, and the enabling signal is at a high level. The first control end 11 is at a low level when the time control chip 10 is at the state after the initialized state is finished.

The gamma chip further includes a storage module 22 configured to store the modulating data.

Of course, the gamma chip 20 further includes a register 24, a digit to analog converter (DAC) 25, and an amplifier 26 connected to the logic control module 21 in sequence. The gamma chip 20 outputs a plurality of signals OUT(1) to OUT(n) by processing the signal inputted to the logic control module.

Figure 3:
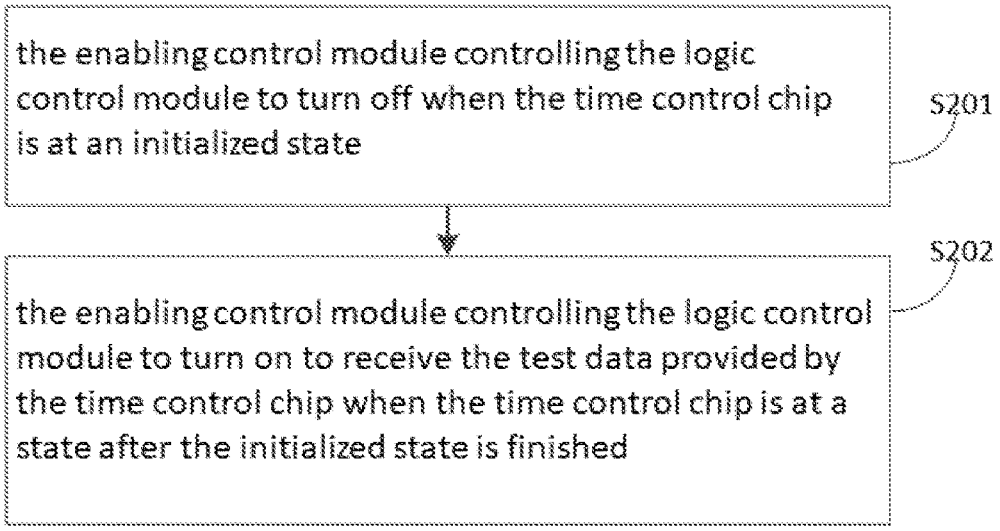
FIG. 3 is a schematic flowchart of a method of driving a display panel according to an embodiment of the present disclosure.

In one embodiment, as shown in FIG. 3, the disclosure provide a method of driving a display panel, applying the above driving circuit to driving the display panel, the method includes steps of:

At step S201: the enabling control module controlling the logic control module to turn off when the time control chip is at an initialized state; and At step S202: the enabling control module controlling the logic control module to turn on to receive the modulating data provided by the time control chip when the time control chip is at a state after the initialized state is finished.

In one embodiment, for processing efficiency, the enabling control module 23 controls the output end 32 and the second control end 34 disconnected to turn off the logic control module 21 when the time control chip 10 is at the initialized state.

The enabling control module 23 controls the output end 32 and the second control end connected to each other to turn on the logic control module 21 to receive the modulating data provided by the multiplex end 12 of the time control chip 10 when the time control chip is at the state after the initialized state is finished.

For improving accuracy of control, in one embodiment of the disclosure, set the first control end 11 at a high level when the time control chip 10 is at the initialized state; and set the first control end 11 at a low level when the time control chip 10 is at the state after the initialized state is finished. For example, in one embodiment, the first control end 11 is default at a high level when the time control chip 10 is at the initialized state, and the time control chip 10 pull down the first control end 11 to a low level when the time control chip 10 is at the state after the initialized state is finished.

Figure 4:
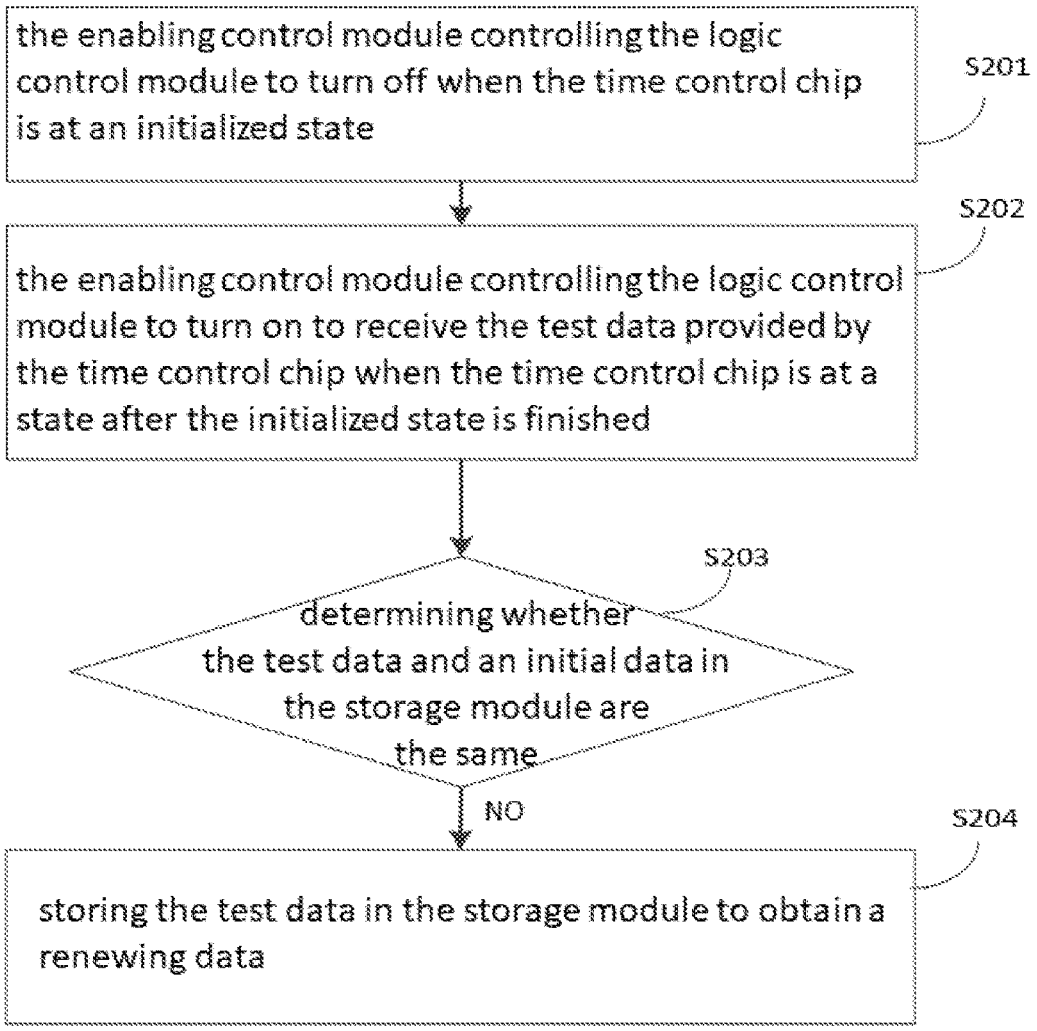
FIG. 4 is a schematic flowchart of a method of driving a display panel according to another embodiment of the present disclosure.

In another embodiment, as shown in FIG. 4, when the logic control module 21 receives the modulating data, the steps includes:

At step S203: determining whether the modulating data and an initial data in the storage module are the same.

Further referring to FIG. 2, the storage module 22 stores a previous modulating data. Determine whether the modulating data this time and the data stored in the storage module are the same. No processes are performed if the data are the same, or else go to a step S204 if not.

At step S204: storing the modulating data in the storage module to obtain a renewing data if the modulating data and the initial data are not the same.

Figure 5:
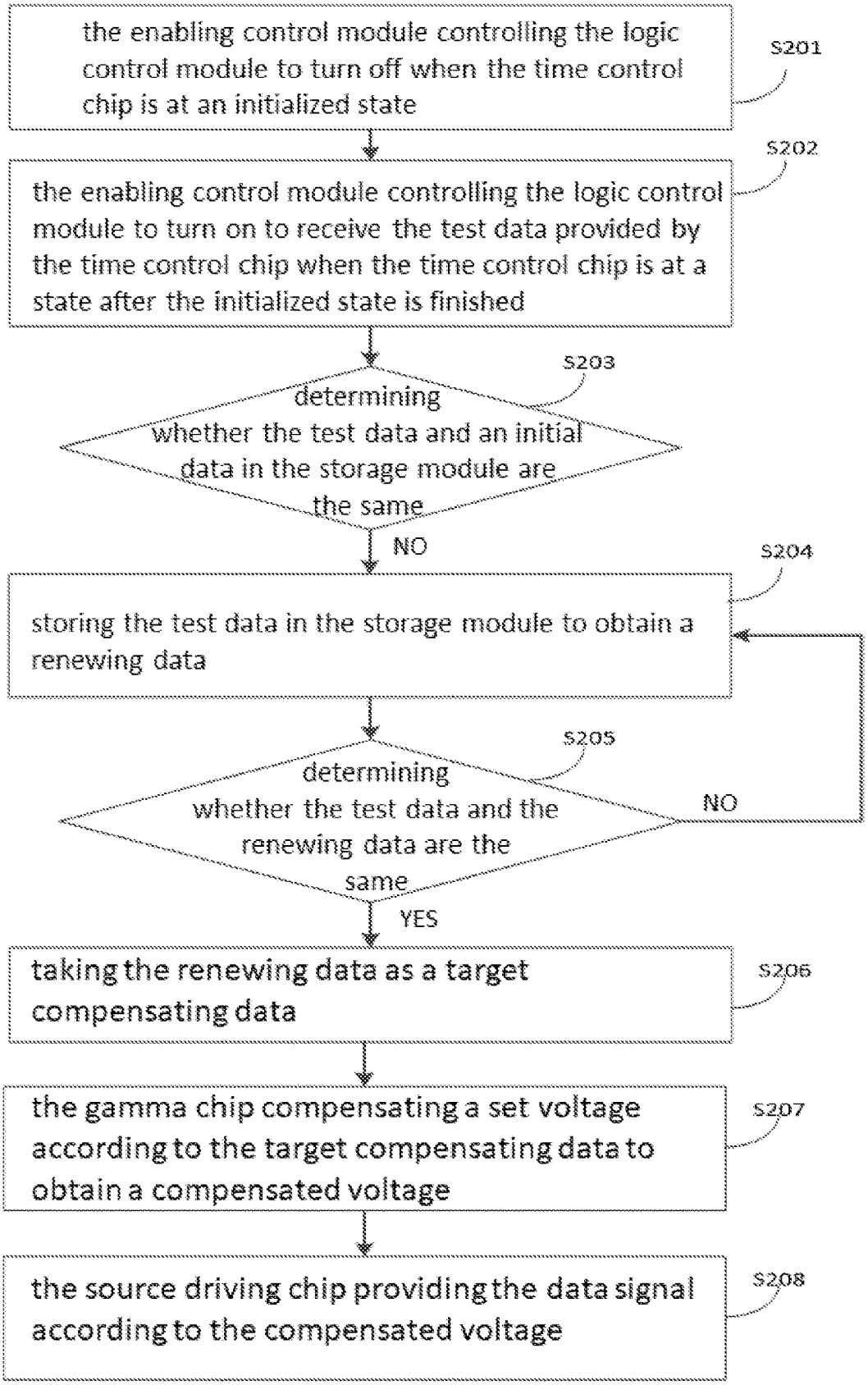
FIG. 5 is a schematic flowchart of a method of driving a display panel according to still another embodiment of the present disclosure.

In another embodiment, as shown in FIG. 5, the above method further includes steps of:

At step S205: determining whether the modulating data and the renewing data are the same.

For example, in order to improve accuracy and avoid from data error stored in the storage module 22, compare the modulating data and the renewing data. If they are the same, it means that the modulating data is written successfully and then go to a step S206. If they are not the same, it means that the modulating data is not written successfully and then return to the step of storing the modulating data to the storage module, that is step S204.

At step S206: taking the renewing data as a target compensating data if the modulating data and the renewing data are determining to be the same.

In another embodiment, the method further includes steps of:

At step S207: the gamma chip 20 compensating a set voltage according to the target compensating data to obtain a compensated voltage.

For example, the gamma chip 20 compensates a gamma voltage according to the target compensating data and output the obtained compensated voltage to the source driving chip. The set voltage is such as an initial gamma voltage. The compensated voltage is configured to obtain a data signal.

At step S208: the source driving chip providing the data signal according to the compensated voltage.

For example, the source driving chip provides the data signal according to the compensated voltage and inputs it in to the display panel to improve display effect.

Because the gamma chip is provided with the enabling control module, the logic control module is turned off when the time control module is at the initialized state, and the logic control module is turned on to receive the modulating data provided by the time control chip when the time control chip is at the state after the initialized state is finished. The time control chip will not transmit an uncertain signal to the gamma chip at the initialized state, and will transmit the modulating data to the gamma chip after the initialized state is finished to avoid the gamma chip from disturbing and to improve display effect.

In comparison with prior art, the driving circuit for the display panel and the method of driving the same of the disclosure provides the enabling control module to turn off the logic control module when the time control module is at the initialized state, and to turn on the logic control module to receive the modulating data provided by the time control chip when the time control chip is at the state after the initialized state is finished. The time control chip will not transmit an uncertain signal to the gamma chip at the initialized state, and will transmit the modulating data to the gamma chip after the initialized state is finished to avoid the gamma chip from disturbing and to improve display effect.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A driving circuit for a display panel, comprising:

a source driving chip connected to the display panel and configured to store modulating data and to provide a data signal to the display panel;

a time control chip configured to obtain the modulating data; and a gamma chip comprising an enabling control module and a logic control module, wherein the enabling control module is connected to the time control chip and configured to control the logic control module turning on or off according to an enabling signal output by the time control chip;

wherein the enabling control module controls the logic control module to turn off when the time control chip is at an initialized state; and wherein the enabling control module controls the logic control module to turn on to receive the modulating data provided by the time control chip when the time control chip is at an end of the initialized state.

2. The driving circuit for the display panel according to claim 1, wherein the time control chip comprises a first control end and a multiplex end;

wherein the enabling control module is further configured to receive a power voltage, the enabling control module comprises an input end and an output end, and the input end is connected to the first control end;

wherein the logic control module comprises a second control end and an input end, and the input end of the logic control module is connected to the multiplex end;

wherein the output end and the second control end are disconnected when the time control chip is at the initialized state; and wherein the output end and the second control end are connected to each other when the time control chip is at a state after the end of the initialized state.

3. The driving circuit for the display panel according to claim 2, wherein the first control end is at a high level when the time control chip is at the initialized state;

wherein the first control end is at a low level when the time control chip is at the end of the initialized state.

4. The driving circuit for the display panel according to claim 1, wherein the gamma chip further comprises a storage module configured to store the modulating data.

5. A method of driving a display panel, applied to a driving circuit for the display panel, wherein the driving circuit comprises: a source driving chip connected to the display panel and configured to store modulating data and to provide a data signal to the display panel, a time control chip configured to obtain the modulating data, and a gamma chip comprising an enabling control module, a logic control module, and a storage module, wherein the enabling control module is connected to the time control chip, and the enabling control module is configured to control the logic control module to turn on or off according to the time control chip, wherein the method comprises steps of:

the enabling control module controlling the logic control module to turn off when the time control chip is at an initialized state;

the enabling control module controlling the logic control module to turn on to receive the modulating data provided by the time control chip when the time control chip is at a state after the initialized state is finished, wherein the enabling control module is further configured to receive a power voltage, the enabling control module comprises an output end, and the logic control module comprises a second control end;

the enabling control module controlling the output end and the second control end to disconnect when the time control chip is at the initialized state; and the enabling control module controlling the output end and the second control end connected to each other when the time control chip is at an end of the initialized state.

6. The method of driving the display panel according to claim 5, wherein the time control chip comprises a first control end and a multiplex end;

wherein the enabling control module is further configured to receive the power voltage, the enabling control module comprises an input end connected to the first control end; and wherein the logic control module comprises an input end connected to the multiplex end.

7. The method of driving the display panel according to claim 6, further comprising steps of:

setting the first control end at a high level when the time control chip is at the initialized state; and setting the first control end at a low level when the time control chip is at the end of the initialized state.

8. The method of driving the display panel according to claim 5, further comprising steps when the logic control module receives the modulating data, wherein the steps comprise:

determining whether the modulating data and initial data in the storage module are same; and storing the modulating data in the storage module to obtain renewing data if the modulating data and the initial data are not the same.

9. The method of driving the display panel according to claim 8, further comprising steps of:

determining whether the modulating data and the renewing data are same;

taking the renewing data as target compensating data if the modulating data and the renewing data are determined to be the same; and returning to the step of storing the modulating data in the storage module if the modulating data and the renewing data are determined to be not the same.

10. The method of driving the display panel according to claim 9, further comprising steps of:

the gamma chip compensating a set voltage according to the target compensating data to obtain a compensated voltage; and the source driving chip providing the data signal according to the compensated voltage.

11. The method of driving the display panel according to claim 5, further comprising a step of:

the enabling control module controlling the logic control module to turn on or off according to an enabling signal output by the time control chip.

12. A method of driving a display panel, applied to a driving circuit for the display panel, wherein the driving circuit comprises: a source driving chip connected to the display panel and configured to store modulating data and to provide a data signal to the display panel, a time control chip configured to obtain the modulating data, and a gamma chip comprising an enabling control module and a logic control module, wherein the enabling control module is connected to the time control chip, and the enabling control module controls the logic control module to turn on or off according to an enabling signal output by the time control chip, wherein the method comprises steps of:

the enabling control module controlling the logic control module to turn off when the time control module is at an initialized state; and the enabling control module controlling the logic control module to turn on to receive the modulating data provided by the time control chip when the time control chip is at an end of the initialized state.

13. The method of driving the display panel according to claim 12, wherein the time control chip comprises a first control end and a multiplex end;

wherein the enabling control module is further configured to receive a power voltage, the enabling control module comprises an input end and an output end, and the input end is connected to the first control end;

wherein the logic control module comprises a second control end and an input end and the input end of the logic control module is connected to the multiplex end;

wherein the enabling control module controls the output end and the second control end to disconnect when the time control chip is at the initialized state; and wherein the enabling control module controls the output end and the second control end to connect to each other when the time control chip is at the end of the initialized state.

14. The method of driving the display panel according to claim 13, further comprising steps of:

setting the first control end at a high level when the time control chip is at the initialized state; and setting the first control end at a low level when the time control chip is at the state after the initialized state is finished.

15. The method of driving the display panel according to claim 12, wherein the gamma chip comprises a storage module, and the method further comprises steps when the logic control module receives the modulating data, wherein the steps comprise:

determining whether the modulating data and initial data in the storage module are same; and storing the modulating data in the storage module to obtain renewing data if the modulating data and the initial data are not the same.

16. The method of driving the display panel according to claim 15, further comprising steps of:

determining whether the modulating data and the renewing data are same;

taking the renewing data as target compensating data if the modulating data and the renewing data are determined to be the same; and returning to the step of storing the modulating data in the storage module if the modulating data and the renewing data are determined to be not the same.

17. The method of driving the display panel according to claim 16, further comprising steps of:

the gamma chip compensating a set voltage according to the target compensating data to obtain a compensated voltage; and the source driving chip providing the data signal according to the compensated voltage.

* * * * *